United States Patent [19]

Kitoh et al.

[11] Patent Number: 4,580,586

[45] Date of Patent: Apr. 8, 1986

[54] VANITY CASE

[75] Inventors: Chihiro Kitoh, Kawasaki; Masayuki Suzumori, Tokyo; Takashi Sugiyama, Kodaira; Nobuhisa Watanabe, Tokyo, all of Japan

[73] Assignees: Pola Chemical Industries Inc., Shizuoka; Yoshida Industry Co., Ltd., Tokyo, both of Japan

[21] Appl. No.: 560,402

[22] Filed: Dec. 12, 1983

[30] Foreign Application Priority Data

Jul. 21, 1983 [JP] Japan ..... 58-112213[U]

[51] Int. Cl.[4] ..... A45D 33/00

[52] U.S. Cl. ..... 132/83 R

[58] Field of Search ..... 132/83 R

[56] References Cited

U.S. PATENT DOCUMENTS 1,753,315 4/1930 Parent ..... 132/83 R 2,062,363 12/1936 Kreisler ..... 132/83 R

*Primary Examiner*—Robert Peshock

*Attorney, Agent, or Firm*—Wenderoth, Lind & Ponack

[57] ABSTRACT

A vanity case comprises a main container having a receptacle and a cover, and a tray for detachably holding the main container therein. The receptacle has a space in which a pair of sliding pieces are disposed for an engagement with a projection of the cover. The sliding pieces are connected together in such manner that the inner ends approach each other to hold the projection therebetween when the outer ends are located away from each other and projected beyond the side walls of the receptacle by an elastic means. A means is provided for maintaining the cover in the closed position and upon rearward movement of the main container with respect to the tray, for releasing the closed position of the cover.

9 Claims, 7 Drawing Figures

10
12
14
16
18
20
22
24
26
28
30
32
34
35
36
37
38
40
42
43
44
46
48
50
51
52
54
56
57
58
59
64
66

VANITY CASE

BACKGROUND OF THE INVENTION

The present invention relates to an improvement of a vanity case and, more particularly, to a vanity case comprising a main container which comprises a receptacle and a cover hinged together, and a tray adapted to be detachable connected to the main container.

A vanity case of the type set forth above is known in which the cover is maintained in a closed position with respect to the receptacle by an engagement of latch tongues formed in the front portions of the cover and the receptacle. In general, cosmetic material is contained in the receptacle and a mirror is fixed to an inner surface of the cover, while the tray is intended to receive small articles such as a puff, brush and the like. The main container is slidably mounted in the tray and when using the vanity case for a make-up, it has been necessary to move the main container rearwardly with respect to the tray for taking out the articles, and then to open the cover by forcedly and manually releasing the engagement of the latch tongues. Therefore, two separate operations are required, furthermore the manual release is sometimes inconvenient particularly if the engagement is tight or if only a narrow space is provided for the release operation between the tray and the main container.

Accordingly, it is an object of the present invention to provide a vanity case of the type set forth above, which permits a one-touch operation when using cosmetic material and/or articles.

Another object of the present invention is a provision of a vanity case in which a cover may be opened with respect to a receptacle without necessity of forceably releasing an engagement therebetween.

A further object of the present invention is to provide a vanity case which enables a user to carry a main container thereof separately from a tray, if so desired.

SUMMARY OF THE INVENTION

According to the present invention, a vanity case comprises a main container having a receptacle and a cover, and a tray. The receptacle and the cover are hinged together at respective rear ends thereof and the cover is urged to an open position with respect to the receptacle by an urge means. The receptacle has a space formed in the front end portion thereof and the cover has a projection extending downwardly from the front end portion thereof, the projection being entered into the space when the cover is in a closed position with respect to the receptacle. Disposed in the space for an engagement with the projection to maintain the cover in the closed position is a lock means which comprises a pair of sliding pieces each having an outer end and an inner end, and an elastic means. The sliding pieces are slidably connected together in such manner that the inner ends approach each other to hold the projection therebetween when the outer ends are located away from each other and projected beyond the side walls of the receptacle by the elastic means. The tray has side walls each of which is formed on the inner surface thereof with a lateral groove adapted to be engaged with the outer end of the sliding piece, thereby detachably receiving the main container in the tray. A means is provided for maintaining the cover in the closed position when the main container is in a frontmost position with respect to the tray, and upon rearward movement of the main container, for releasing the closed position of the cover.

Preferably, the means for maintaining and releasing the closed position of the cover comprises the lateral grooves in the tray, each of which grooves includes a deep section formed in a front portion thereof and a shallow section. The deep sections have sufficient depth to permit the outer ends of the sliding pieces to lie freely extended away from each other, thereby to hold the projection of the cover between the inner ends, while the shallow sections press the outer ends inwardly against the elastic means thereby disengaging the projection from the inner ends.

Each of the sliding pieces may include a rod body and a support, and the inner end may have a hook-like portion, and one sliding piece may be slidable along an upper surface of the rod body of the other sliding piece. The elastic means may be fitted between the supports.

The elastic means preferably comprises a coil spring, and the urge means may comprise a spring, one end of which is in contact with a lower surface of the cover and the other end touches the receptacle.

Further objects and features of the present invention will become apparent from the following detailed description of preferred embodiments thereof when taken in conjunction with the accompanying drawings, in which:

DETAILED DESCRIPTION OF THE INVENTION

Figures 1, 2:
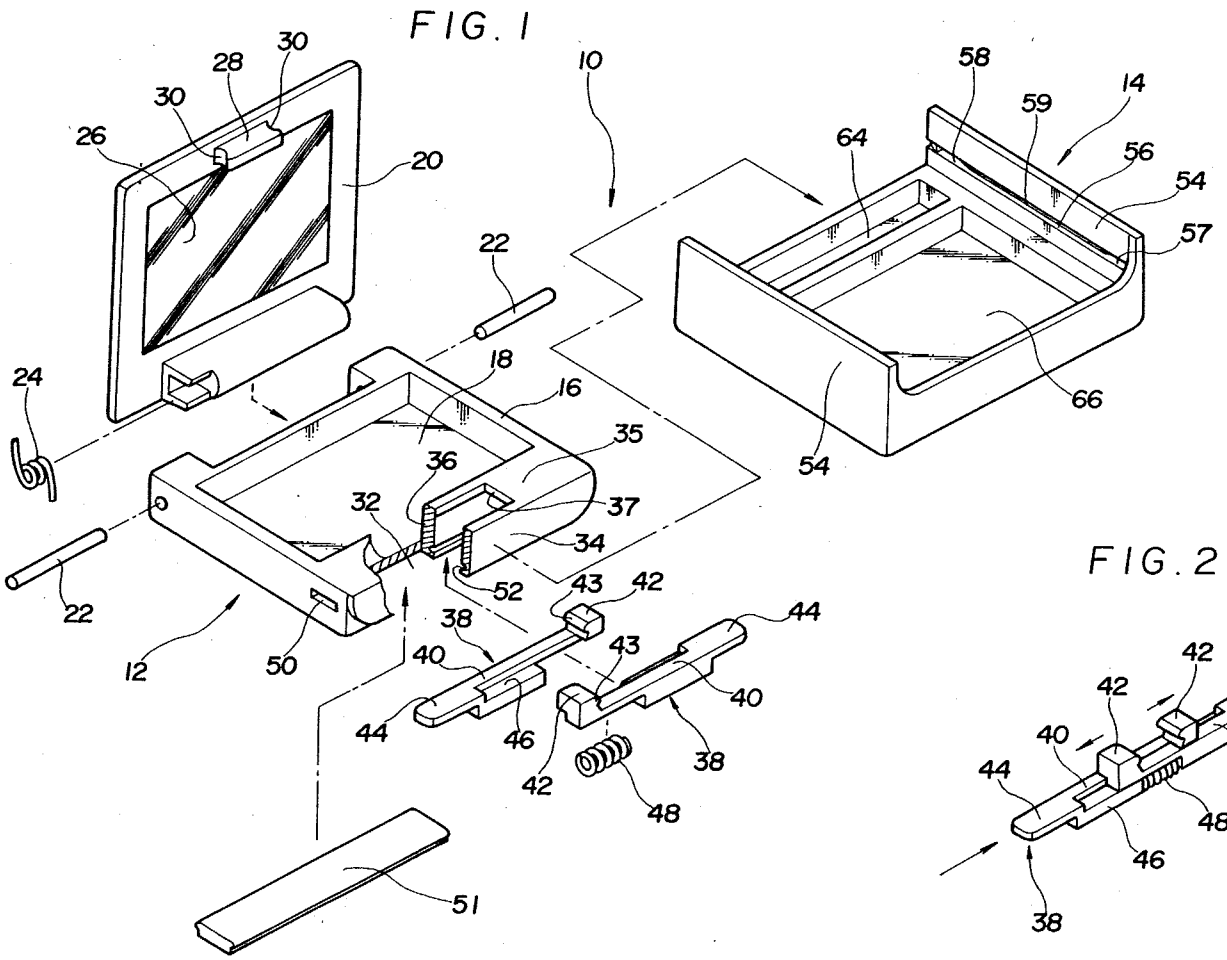
FIG. 1 is an exploded perspective view illustrating a vanity case according to a preferred embodiment of the present invention.
FIG. 2 is a perspective view showing a pair of sliding pieces in FIG. 1 but in a combined condition.

Referring now to the drawings, there is shown a vanity case 10 according to a preferred embodiment of the present invention. The vanity case 10 generally comprises a main container 12 and a tray 14 which may be detachably connected to the main container 12 as hereinafter described in detail.

As best shown in FIG. 1, the main container 12 includes a receptacle 16 having a recess 18 for receiving cosmetic material, and a cover 20 hinged with the receptacle 16 at the rear ends by a pair of pins 22 so that the cover 20 may open or close with respect to the receptacle 16. The cover 20 is urged to its open position by elastic means, for example, by a coil spring 24 which is fitted around the pin 22 with one end of the spring being in contact with a lower surface of the cover 20 while another end thereof touching a rear end of the receptacle 16. A mirror 26 is fixed to the inner surface of the cover 20 and a projection 28 extends downwardly from a front margin of the inner surface. The projection 28 is formed integrally with the cover 20 and is preferably provided with curved recesses or arcs at its sides 30—30.

The receptacle 16 has a space 32 which is defined between a front end wall 34 and a partition 36 which separates the recess 18 from the space 32. Disposed in the space 32 is a lock means comprising a pair of sliding pieces 38—38 for an engagement with the projection 28 when the cover 20 is closed over the receptacle 16. Each sliding piece 38 has a rod body 40 an inner end of which extends upwardly to provide a hook-like portion 42, and an outer end 44 of the rod 40 has a width which permits a support 46 to extend toward the inner end 42 in parallel with the rod 40 but in a level lower than the rod to provide a step therebetween. In assembly, the sliding pieces 38—38 are joined together in such a manner that the hook-like portions 42 are faced towards each other, and that the respective hook portion of one rod body is slidable along an upper surface of the other rod body 40, as shown in FIG. 2. A coil spring 48 or other suitable elastic member is fitted between the supports 46—46 to urge the sliding pieces 38—38 outwardly, i.e. in a direction where the outer ends 44—44 are away from each other while the inner ends 42—42 approach each other.

Figure 3:
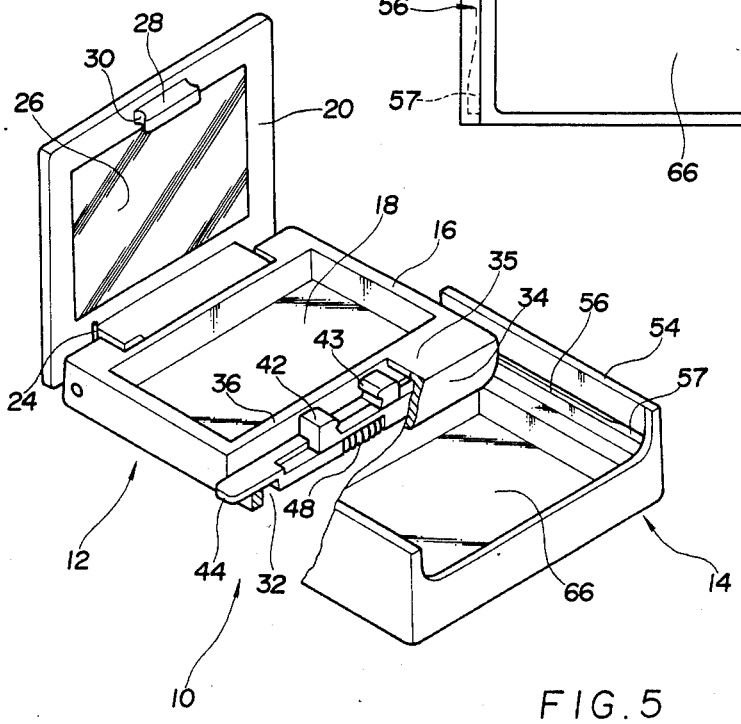
FIG. 3 is a partially sectioned perspective view of the vanity case after assembly.

Provided through each side wall of the receptacle 16 to communicate with the space 32 is a slot 50 which permits the outer end 44 of the piece 38 to project outwardly beyond the side wall, as shown in FIG. 3. The space 32 is further defined by an upper wall 35 in which a rectangular hole 37 is formed to enable the approached hook-like portions 42—42 to hold the projection 28 of the cover 20 therebetween. The portion 42 is preferably provided with a radiused tooth 43 for preventing slip disengagement. Defining of the space 32 is completed by a bottom plate 51 which is, after the sliding pieces 38 are inserted in the space 32, fitted between the partition 36 and the end wall 34 and held by grooves 52.

Figure 4:
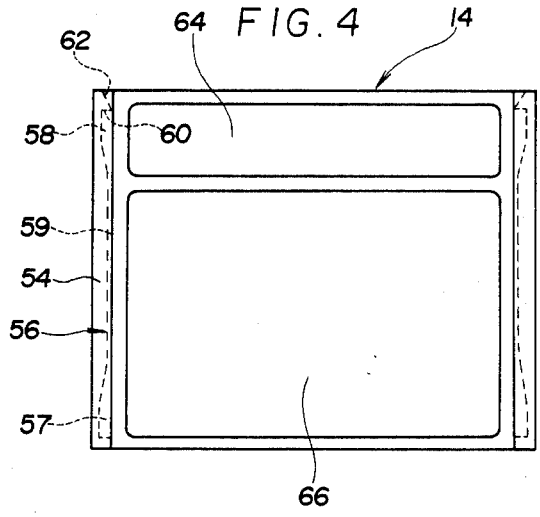
FIG. 4 is a plane view showing a tray in FIG. 1 with grooves being illustrated by dotted lines.

The tray 14 has upwardly extended side walls 54—54 and each of the side walls is provided at an inner surface thereof with a groove 56 extending in a lateral direction. The groove 56 is engageable with the outer end 44 of the sliding piece 38 projecting from the receptacle 16 to detachably connect the main container 12 to the tray 14. As shown in FIG. 4, each groove 56 comprises deep sections 57 and 58 formed at front and rear portions thereof, respectively, and a shallow intermediate section 59. The deep sections 57 and 58 have sufficient depth to permit the hook-like portions 42 to approach each other for holding the projection 28 therebetween, while the shallow sections 59 will push the outer ends 44 inwardly against the spring 48. It should be noted that the provision of the rear deep section 58 is not essential but is preferable if it is desired for a user to check the engagement of the outer ends 44 of the sliding pieces with the grooves 56 at an initial insertion. A stopper 60 is provided at the end of the grooves 56 and an inclined guide surface 62 may be formed to facilitate the insertion of the outer ends 44 of the sliding pieces into the grooves 56.

Further provided in the tray 14 are concave rooms 64 and 66 for receiving cosmetic material and/or small articles such as a puff, brush and the like. It will be apparent that the concave space may be divided into any desired number of rooms.

The vanity case 10 may be generally formed of a synthetic resin material, but some of the parts, such as the springs 24 and 48 and the pins 22, may be made of metal.

Figure 5:
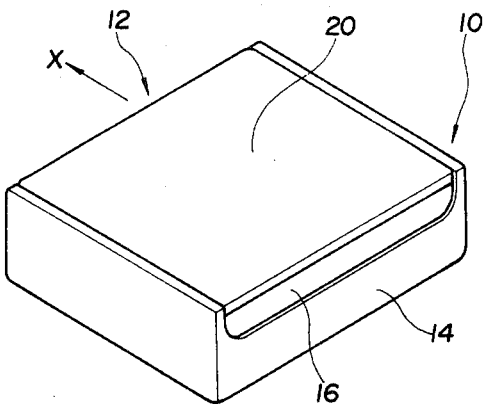
FIG. 5 is a perspective view of the vanity case with a main container being completely received in the tray.

FIG. 5 shows the vanity case 10 in a completely assembled condition where the main container 12 is entirely received in the tray 14 with the outer ends 44 of the sliding pieces 38 being positioned in the front deep sections 57 of the grooves 56. Thus, the outer ends 44 are freely projecting in opposite directions thereby allowing the spring 48 to cause the inner hook-like portions 42 to approach each other, and thereby holding the projection 28 between the portions 42 and locking the cover 20 in the closed position with respect to the receptacle 16.

Figure 6:
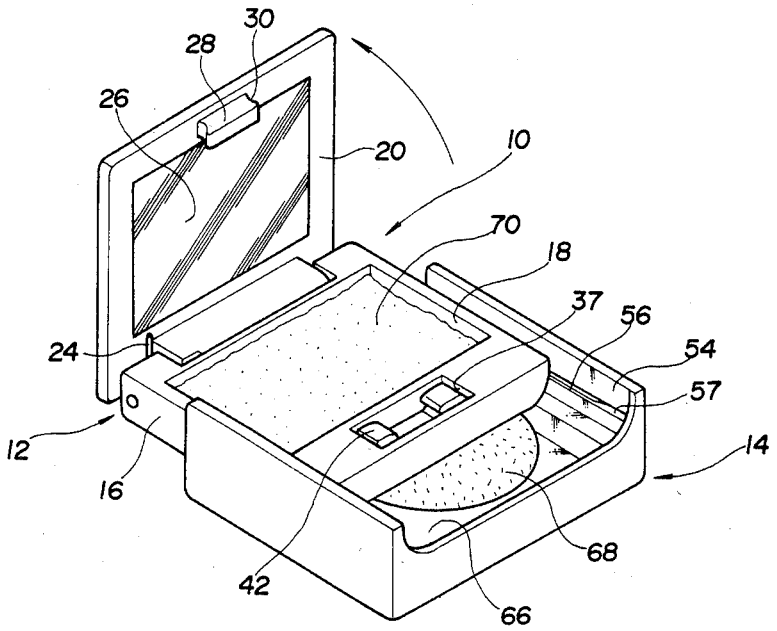
FIG. 6 is a perspective view for explaining an operation of the vanity case.

Assuming now that the vanity case 10 is in the condition as shown in FIG. 5, when the main container 12 is moved rearwardly, i.e. to the direction indicated by an arrow X, with respect to the tray 14, the shallow sections 59 of the grooves 56 push the outer ends 44 of the sliding pieces inwardly against the spring 48 to move the inner hook-like portions 42 away from each other. The projection 28 is therefore released from the engagement and the spring 24 opens the cover 20 with respect to the receptacle 16, as illustrated in FIG. 6. Thus, the rearward movement of the main container 12 enables the user not only to take out the puff 68 or any other articles in the tray 14 but also to use cosmetic material 70 in the recess 18 and the mirror 26. After finishing make-up, the user may close the cover 20 over the receptacle 16 by hand and move the main container 12 forwardly for the engagement of the projection 28 with the hook-like portions 42 which will be at that time at minimum spacing to each other.

Figure 7:
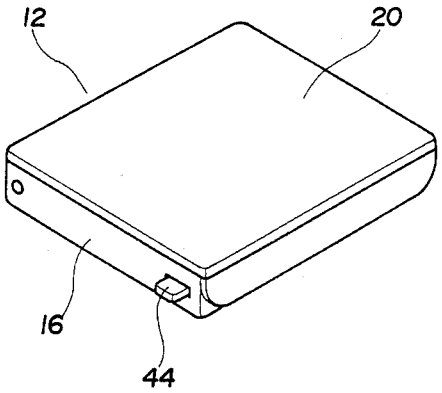
FIG. 7 is a perspective view of the main container separated from the tray.

The stopper 60 in the groove 56 prevents an unintentional separation of the main container 12 from the tray 14. If desired, however, the container 12 may be drawn out from the tray 14 by applying sufficient force to cause the outer ends 44 to be depressed enough to clear the stoppers 60. Once the outer ends 44 are disengaged from the grooves 56, the spring 48 projects the ends 44 outwardly to cause the hook-like portions 42 to hold the cover 20 in the closed position as shown in FIG. 7. Pressing the outer ends 44 inwardly by fingers will open the cover 20, and in order to close the cover 20 it will be only necessary to rotate the cover 20 around the pins 22, which will eventually bring the projection 28 into contact with the radiused parts of the hook portions 42 thereby causing the hook portions to move in the direction away from each other and then the reverse movement thereof for engagement of the radiused sides 30 with the teeth 43. Therefore, the operations to open and close the cover 20 with respect to the receptacle 16 are very convenient even if the main container 12 is carried alone or separately from the tray 14.

In the above embodiment, the cover 20 is held in the closed position by the engagement of the projection 28 with the hook-portions 42 when the main container 12 is completely received in the tray 14. However, it is to be noted that other structures may be employed to achieve the same effect. For example, the cover 20 may include a pair of members extending from the rear portion of each side of the cover, and the tray 14 may have additional grooves for engagement with the members. The cover 20 can be held in the closed position when the members are engaged with the additional grooves and will be opened by the rearward movement of the main container 12 to disengage the members from the grooves. If such a structure is employed, the deep section 57 of the groove 56 may be omitted and replaced by a continuation of the shallow section 59.

Although the present invention has been described with reference to the preferred embodiments thereof, many modifications and alterations may be made within the spirit of the present invention.

What is claimed is:

1. A vanity case comprising:

a main container comprising a receptacle and a cover, said receptacle and said cover being hinged together at respective rear ends thereof, and said cover being urged to an open position with respect to said receptacle by an urge means;

said receptacle having a space formed in a front end portion thereof, and said cover having a projection extending downwardly from a front end portion thereof, said projection being entered in said space when said cover is in a closed position with respect to said receptacle;

a lock means disposed in said space and engageable with said projection to maintain said cover in said closed position, said lock means comprising a pair of sliding pieces each having an outer end and an inner end, and an elastic means, and said pair of sliding pieces being slidably connected together in such manner that said inner ends approach each other to hold said projection therebetween when said outer ends are located away from each other and projected beyond respective side walls of said receptacle by said elastic means;

a tray having side walls, each said side wall being formed on an inner surface thereof with a lateral groove, said lateral groove being adapted to be engaged with said outer end of said sliding piece thereby detachably receiving said main container in said tray; and a means for maintaining said cover in said closed position when said main container is in a frontmost position with respect to said tray and upon rearward movement of said main container, for releasing said closed position of said cover.

2. A vanity case as claimed in claim 1, wherein said means for maintaining and releasing said closed position of said cover comprises said lateral grooves in said tray, each said groove including a deep section formed in a front portion thereof and a shallow section, said deep sections having enough depth to permit said outer ends of said sliding pieces to be freely extended away from each other thereby to hold said projection of said cover between said inner ends, and said shallow sections pressing said outer ends inwardly against said elastic means thereby disengaging said projection from said inner ends.

3. A vanity case as claimed in claim 1, wherein each said sliding piece includes a rod body and a support, each said inner end has a hook-like portion and is slidable along an upper surface of said rod body of the other sliding piece, and said elastic means are fitted between said supports.

4. A vanity case as claimed in claim 3, wherein said elastic means comprises a coil spring.

5. A vanity case as claimed in claim 3, wherein each said hook-like portion includes a tooth and said projection includes recessed sides, said tooth being engageable with each said side.

6. A vanity case as claimed in claim 1, wherein said urge means comprises a spring having two projecting ends, one end thereof being in contact with a lower surface of said cover and the other end touching said receptacle.

7. A vanity case as claimed in claim 1, wherein said space is defined by a front end wall, a partition, side walls and an upper wall of said receptacle and a bottom plate, each said side wall of said receptacle being provided with a slot through which said outer end of said sliding piece projects outwardly.

8. A vanity case as claimed in claim 2, wherein each said groove includes an additional deep section formed in a rear portion thereof, said shallow section connecting both deep sections.

9. A vanity case as claimed in claim 2, wherein a stopper is formed at a rear end of each said groove.

* * * * *